US011479933B2

(12) United States Patent
Stone

(10) Patent No.: US 11,479,933 B2
(45) Date of Patent: Oct. 25, 2022

(54) VEHICLE IMPACT BARRIER SYSTEM AND VEHICLE IMPACT BARRIER UNIT FOR USE THEREIN

(71) Applicant: Mark A. Stone, Ashbourne (GB)

(72) Inventor: Mark A. Stone, Ashbourne (GB)

( * ) Notice: Subject to any disclaimer, the term of this patent is extended or adjusted under 35 U.S.C. 154(b) by 150 days.

(21) Appl. No.: 16/612,388

(22) PCT Filed: May 10, 2018

(86) PCT No.: PCT/GB2018/051266

§ 371 (c)(1),
(2) Date: Nov. 10, 2019

(87) PCT Pub. No.: WO2018/206966

PCT Pub. Date: Nov. 15, 2018

(65) Prior Publication Data

US 2020/0199834 A1 Jun. 25, 2020

(30) Foreign Application Priority Data

May 10, 2017 (GB) ..... 1707483
Aug. 18, 2017 (GB) ..... 1713320

(51) Int. Cl.

| | |
|---|---|
| ***E01F 13/02*** | (2006.01) |
| ***E01F 13/12*** | (2006.01) |
| ***E01F 15/00*** | (2006.01) |
| ***E01F 15/08*** | (2006.01) |

(52) U.S. Cl.

CPC ..... *E01F 13/12* (2013.01); *E01F 13/02* (2013.01); *E01F 13/028* (2013.01); *E01F 15/003* (2013.01); *E01F 15/08* (2013.01)

(58) Field of Classification Search

CPC ..... E01F 13/028; E01F 13/12; E01F 13/123; E01F 15/003; E01F 15/08; E01F 15/10; E01F 13/02

See application file for complete search history.

(56) References Cited

U.S. PATENT DOCUMENTS 5,123,774 A * 6/1992 Dubiel ..... E01F 13/12 404/6
5,322,385 A * 6/1994 Reisman ..... E01F 13/12 256/1
5,335,471 A * 8/1994 Kupiec ..... E01F 15/003 248/218.4

(Continued)

FOREIGN PATENT DOCUMENTS

DE 21 32 151 A1 1/1973
DE 102007060506 B3 * 4/2009 ..... F41H 11/08

(Continued)

OTHER PUBLICATIONS

International Searching Authority: International Search Report, App. No. PCT/GB2018/051266 (dated Sep. 17, 2018).

(Continued)

*Primary Examiner* — Gary S Hartmann
(74) *Attorney, Agent, or Firm* — Walters & Wasylyna LLC

(57) ABSTRACT

Vehicle impact barrier system (300) comprising a series of impact barrier units (310) and at least one linkage means (332). A first impact barrier unit is linked to at least one other impact barrier unit by said at least one linkage means.

17 Claims, 14 Drawing Sheets

(56) References Cited

U.S. PATENT DOCUMENTS

| | | | | |
|---|---|---|---|---|
| 6,045,293 | A * | 4/2000 | Dickinson | E01F 13/123 256/1 |
| 6,048,128 | A | 4/2000 | Jones, III et al. | |
| 6,808,291 | B1 | 10/2004 | Aylward et al. | |
| 6,971,329 | B1 * | 12/2005 | Stewart | E01F 13/028 116/63 C |
| 6,994,488 | B2 * | 2/2006 | Crowley, Sr. | E01F 13/12 404/6 |
| 7,118,305 | B1 * | 10/2006 | Corbett | E01F 13/12 404/6 |
| 7,226,238 | B2 * | 6/2007 | Collier | E01F 13/12 404/6 |
| 7,654,768 | B1 * | 2/2010 | Tullis | E01F 15/083 404/6 |
| 10,370,807 | B2 * | 8/2019 | Stevens | F41H 11/08 |
| 10,415,198 | B1 * | 9/2019 | Thomas | E01F 13/02 |
| 10,988,903 | B1 * | 4/2021 | Neusch | E01F 9/685 |
| 2006/0078380 | A1 | 4/2006 | Dehart | |
| 2009/0263190 | A1 * | 10/2009 | Segal | E01F 13/12 404/6 |
| 2014/0010591 | A1 * | 1/2014 | Ball | E01F 9/685 404/6 |
| 2018/0135262 | A1 * | 5/2018 | Stevens | E01F 15/006 |
| 2020/0056339 | A1 * | 2/2020 | Ball | E01F 13/02 |
| 2021/0010216 | A1 * | 1/2021 | McKenna | E01F 13/044 |

FOREIGN PATENT DOCUMENTS

| | | | | |
|---|---|---|---|---|
| DE | 202017107900 | U1 * | 1/2018 | E01F 13/12 |
| DE | 202018002105 | U1 * | 7/2018 | E01F 13/12 |
| FR | 1073593 | A * | 9/1954 | E01F 13/12 |
| FR | 2610338 | | 8/1988 | |
| GB | 2178094 | | 2/1987 | |
| GB | 2282623 | | 4/1995 | |
| GB | 2480334 | A * | 11/2011 | E01F 13/12 |
| GB | 2487613 | A * | 8/2012 | E01F 13/12 |
| GB | 2562059 | A * | 11/2018 | E01F 13/02 |
| KR | 200410335 | Y1 * | 3/2006 | |
| WO | WO-2006052115 | A1 * | 5/2006 | E01F 15/065 |
| WO | WO-2019035117 | A1 * | 2/2019 | E01F 13/12 |

OTHER PUBLICATIONS

International Searching Authority: International Preliminary Report on Patentability, App. No. PCT/GB2018/051266 (dated Nov. 12, 2019).

* cited by examiner

VEHICLE IMPACT BARRIER SYSTEM AND VEHICLE IMPACT BARRIER UNIT FOR USE THEREIN

This application is a U.S. national phase application of Intl. App. No. PCT/GB2018/051266 filed on May 10, 2018, which claims priority from GB1707483.2 filed on May 10, 2017, and GB1713320.8 filed on Aug. 18, 2017. The entire contents of Intl. App. No. PCT/GB2018/051266, GB1707483.2 and GB1713320.8 are incorporated herein by reference.

FIELD OF THE INVENTION

The present invention relates to a vehicle impact barrier system and to one or more vehicle impact barrier units for use therein. More particularly, but not exclusively, to a deployable or portable vehicle impact barrier system that can be utilised on a temporary basis for example, at a festival, market or concert. The invention finds advantageous application in locations where other vehicle impact barriers cannot be installed or where it is undesirable to permanently locate vehicle impact barriers, for example, in parks, fields, and areas temporarily pedestrianised. In areas temporarily pedestrianised, for example, a street or number of streets which at other times allow the passage of vehicles, but in which an event is hosted, for example, a temporary market, a portable and temporary vehicle impact barrier system according to the present disclosure may be very beneficial. The vehicle impact barrier system may be used on a longer-term or permanent basis if required.

Aspects of the invention relate to a vehicle impact barrier system, to an impact barrier unit, and to a method.

BACKGROUND OF THE INVENTION

It is known to provide barriers that are suitable for withstanding impacts from a vehicle. Such barriers typically comprise concrete blocks placed upon the ground, or vertical posts embedded within the ground. In order to provide sufficient resistance to impacts from vehicles moving at typical speeds (e.g. 30 to 60 kilometres per hour), the concrete blocks must be very heavy and large, or the posts must be deeply embedded in the ground, to enable them to absorb and/or disperse the high energies involved. Such barriers cannot be placed in locations that are only temporarily being used to host an event where crowds of people may be present. For example, a festival hosted over a few days in a field or a festive market held in a town for only a few weeks. In such situations where after the event has finished, the site will go back to being a field, or an area where traffic can pass, the temporary installation of concrete blocks or barriers embedded in the ground may not practical, may cause damage to the site, may be economically prohibitive and/or may take too long.

The present invention seeks to provide an improvement in the field of vehicle impact barriers that has particular application for situations in which a temporary barrier solution is required. The invention may be utilised in applications other than for temporary barrier solutions.

SUMMARY OF THE INVENTION

According to one aspect of the invention, there is provided a vehicle impact barrier system comprising a series of impact barrier units and at least one linkage means, wherein a first impact barrier unit is linked to at least one other impact barrier unit by said at least one linkage means. The vehicle impact barrier units may be freestanding and by not being affixed to the ground, they can move and interfere with the progression of a vehicle and arrest the vehicle.

Optionally, the at least one linkage means comprises a first linkage means coupled to a lower portion of a first impact barrier unit and also coupled to a lower portion of a second impact barrier. The connected units drag about a vehicle to arrest its progress.

Optionally, each impact barrier unit comprises an outer shell and an internal structure. The outer shell may be lighter in weight than the internal structure and may be made of a high-density plastics or other suitable material. The outer shell may be decorated or coloured to match a theme of an event at which the impact barrier unit is being used.

Optionally, the outer shell provides an incomplete shroud over the internal structure such that a bottom portion of the internal structure extends below lowest edges of the outer shell. This may facilitate lifting of the impact barrier unit by a fork-lift for loading and off-loading the units.

Optionally, the internal structure is arranged to provide multiple anchors for engagement with a vehicle, said multiple anchors may be disposed at two or more different heights above ground level.

Optionally, the impact barrier units are each free-standing and the whole system is free-standing and portable.

Optionally, the first linkage means is coupled to the internal structure of the first unit and the second linkage means is also coupled to the internal structure of the first unit.

Optionally, the internal structure comprises a series of rows of anchoring members, wherein the anchoring members of a first row are disposed at a different height above ground level compared to the anchoring members of a second row. A front most row of anchoring members may project to a first height and a second row of anchoring members disposed further away from the front of the unit than the first row may project to a second height, and the second height is preferably greater than the first height.

Optionally, the internal structure comprises a plurality of rows of anchoring members and the anchoring members of a front most row project to a first height and wherein anchoring members of a further row project to a second height that is greater than the first height. At least one or more subsequent rows of anchoring members project to progressively greater heights still.

Optionally, the internal structure comprises a plurality of fins and wherein anchoring members project from each fin. Optionally, the anchoring members are generally triangular in shape.

Each fin may have an upper edge that follows a generally diagonal path extending between a front edge and rear edge, said upper edge may be interrupted by a series of anchor members such that the upper edge comprises a series of plateaus and peaks.

Optionally, a leading or front most anchor member of each fin is disposed lower most and front most, and projects from an angled section of the upper edge. Said angled section may be inclined at an angle of between about 15° and about 30°. Optionally, the angled section is inclined at an angle of about 20° and the leading or front most anchor member points in a slightly more forward direction compared to other anchor members in the series.

Optionally, a plurality of fins are aligned and affixed together in spaced relationship and thereby the series of rows of anchoring members are provided.

Optionally, the first linkage means passes through one or more fins of the internal structure and the second linkage means passes though one or more of the other fins of the internal structure.

Optionally, the plurality of fins comprises first and second end-most fins and the first linkage means passes through the first end-most fin and the second linkage means passes through the second end-most fin.

Optionally, the internal structure comprises six fins, arranged in parallel and arranged in a spaced arrangement. The fins may each comprise one or more or a series of slots and the internal structure may further comprise one or more or a matching number of transverse members, onto which said fins are slot-fitted and affixed.

Optionally, each internal structure comprises four transverse members, onto which six fins are slot-fitted and attached, wherein each fin has a front edge and a rear edge, the rear edge having a greater height above ground level than the front edge, and wherein first and second end-most fins receive part of the first linkage means and part of the second linkage means respectively.

Each internal structure may comprise a central bottom plate having an aperture with an internal thread for receiving, locating and fastening a locking bolt. A further plate may be disposed between two fins and affixed thereto and may be disposed above the central bottom plate. The further plate may comprises an aperture appropriately aligned relative to the internal thread in the bottom plate such that the locking bolt is securely held in place therein and such that said two linkage means are securely coupled to the internal structure of the impact barrier unit.

Optionally, each impact barrier unit comprises an outer shell and an internal structure. Optionally, said internal structure comprises a bottom structure, and wherein the bottom structure is located in a bottom half of said unit and is sized, arranged and of a weight such that the impact barrier unit has a low centre of mass.

Optionally, between 85% and 90% of the mass of the unit is provided by the bottom structure.

Optionally, the outer shell is generally wider at its bottom than at its top such that it has a tapered or bell-shaped form.

Optionally, the bottom structure comprises at least one fin, wherein said at least one fin comprises first and second bottom edges and wherein the first and second bottom edges are disposed at an angle of between about 120° and about 160°.

Optionally, the first and second bottom edges are disposed at an angle of 150°.

Optionally, one or more fins comprise one or more teeth provided thereon.

Optionally, said internal structure comprises a spindle member and wherein said spindle member comprises one or more anchor members provided thereon.

Optionally, said first linkage means is coupled to an upper portion of said spindle members of the first and second impact barrier units respectively; and wherein said second linkage means is coupled to the bottom structures of the first and second impact barrier units respectively.

Optionally, each vehicle impact barrier unit has a total mass of 300 kg or more, has a height of 2 m or more and has 85% or more of its mass situated below half of its height.

According to another aspect of the invention for which protection is sought, there is provided a vehicle impact barrier unit for use in a system according to any of the relevant preceding paragraphs.

According to yet another aspect of the invention for which protection is sought, there is provided a method of restricting passage of a vehicle from a first location to a second location, the method comprising providing a plurality of free standing units linked one to the next in series between said first and second locations, wherein each free-standing unit has a total mass of 300 kg or more, has a height of 2 m or more and has 85% or more of its mass below half of its height.

According to an even further aspect of the present invention, there is provided a method of restricting passage of a vehicle from a first location to a second location, the method comprising providing a plurality of free standing units linked one to the next in series between said first and second locations, wherein each free standing unit has an outer shell and an internal structure, the internal structure comprising a plurality of rows of anchoring members and wherein the anchoring members of a front most row project to a first height and wherein anchoring members of a row spaced back from the front most row project to a second height that is greater than the first height and wherein at least one or more subsequent rows of anchoring members project to progressively greater heights still.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Detailed descriptions of specific embodiments of the vehicle impact barrier systems and one or more vehicle impact barrier units of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the vehicle impact barrier systems and one or more vehicle impact barrier units described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
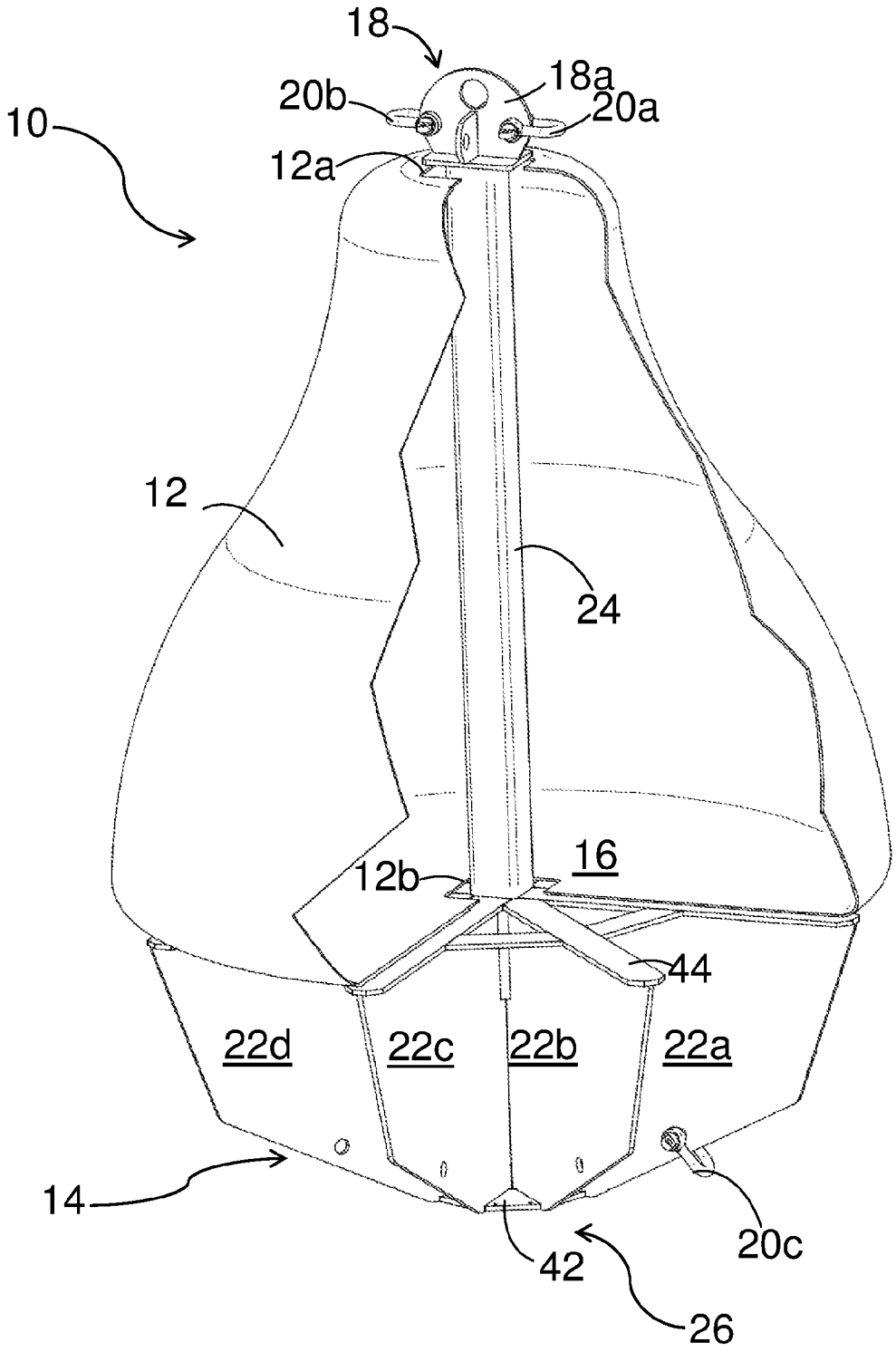
FIG. 1 is a perspective view of a vehicle impact barrier unit according to an embodiment of the invention, with a section of an outer shell of the unit cutaway in order to illustrate an internal structure of the unit.
Figure 3:
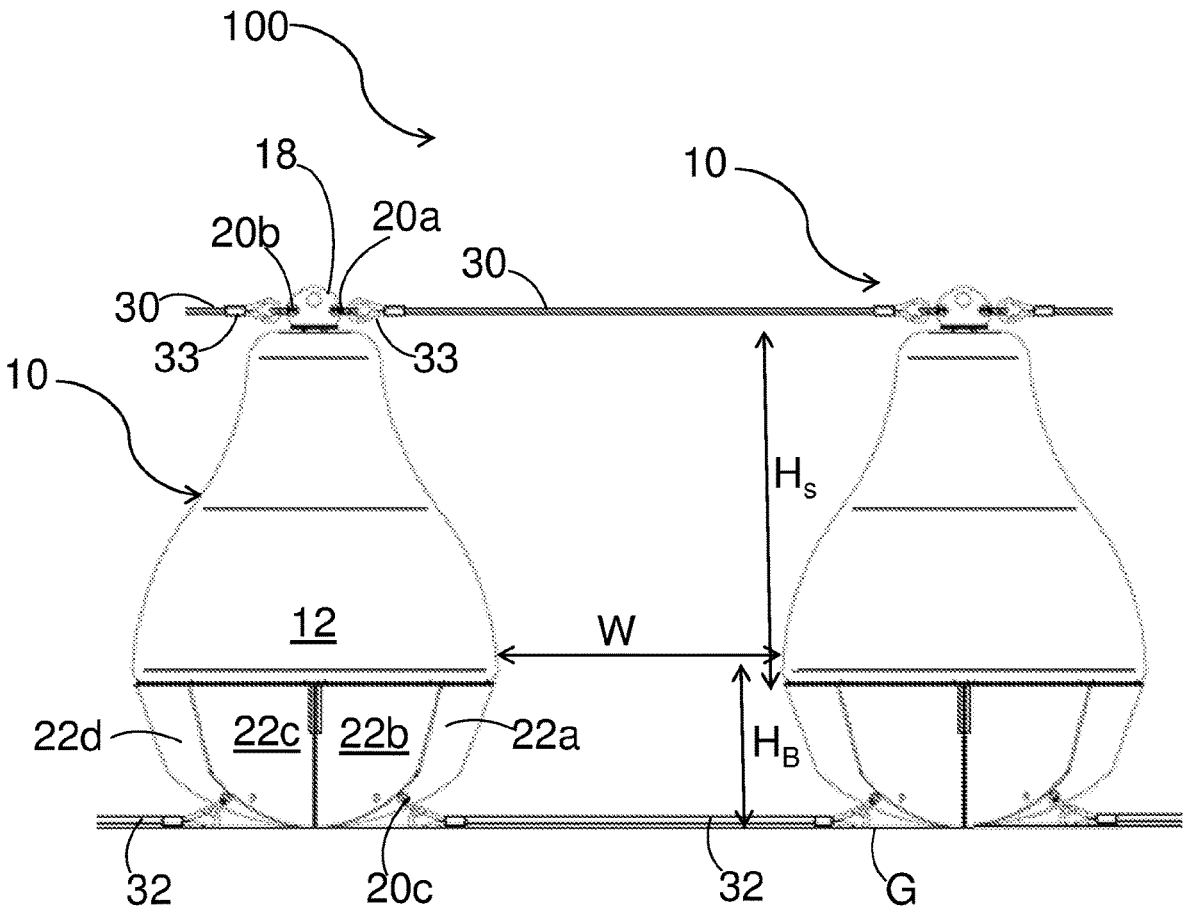
FIG. 3 is an enlarged view of a section of a system comprising the vehicle barrier impact units of FIG. 1.
Figure 5:
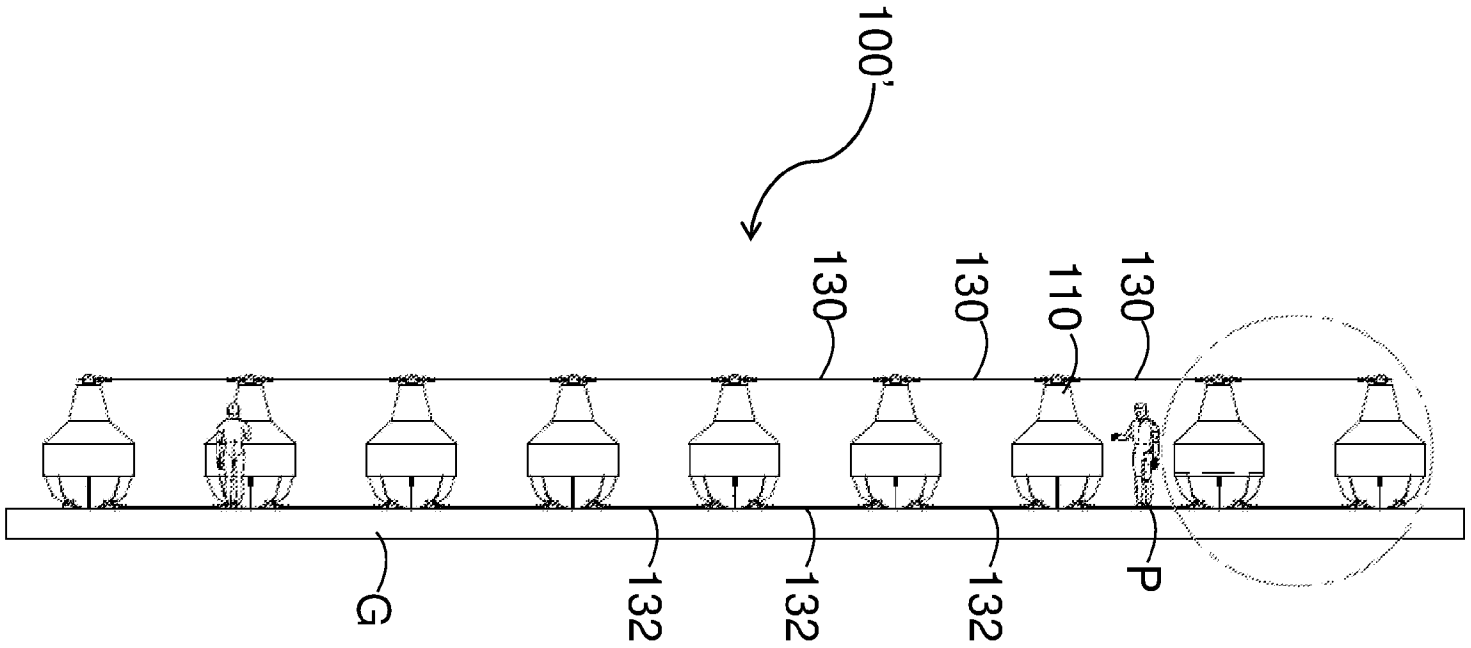
FIG. 5 is a front plan view of a vehicle impact barrier system according to an embodiment of the invention, wherein a series of units of another embodiment are linked together.

Referring to FIG. 1, there is shown a vehicle impact barrier unit 10 that comprises: an outer shell 12; and an internal structure 26. The unit 10 is for use in a vehicle impact barrier system 100 shown, in part, in FIG. 3. In use, the system 100 may stop a vehicle borne attack. A system 100' according to another embodiment is shown in FIG. 5. As shown in FIGS. 3 and 5, the system 100, 100' of the present disclosure comprises a series of impact barrier units 10, 110 and at least one linkage means 30, 32; 130, 132 coupling a first impact barrier unit 10, 110 to at least one other impact barrier unit 10, 110. The linkage means 30, 32; 130, 132 may comprise one or more upper linking elements 30, 130 and one or more lower linking elements 32, 132.

Figure 2:
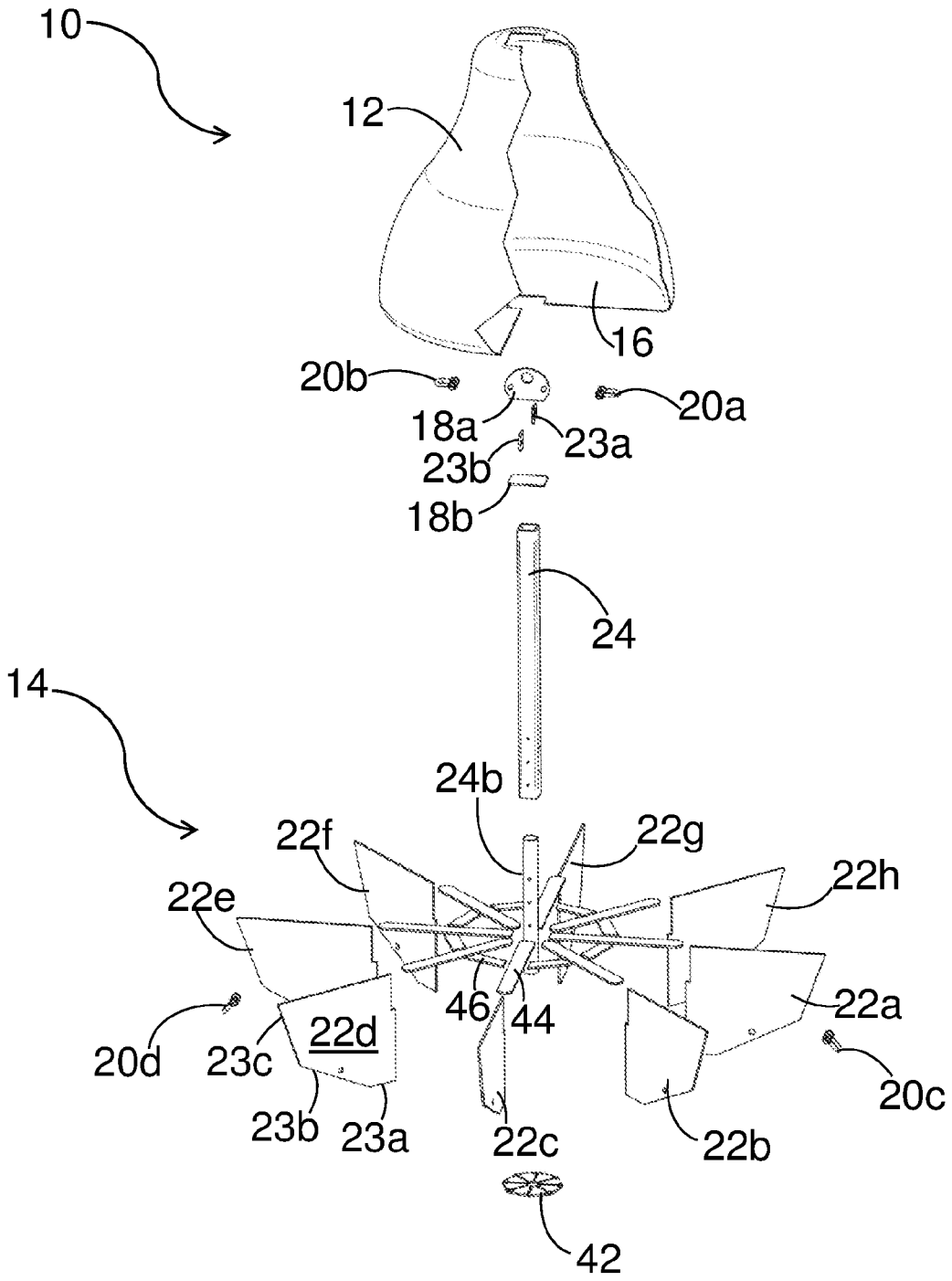
FIG. 2 is an exploded view of the unit of FIG. 1 showing various component parts thereof including the outer shell of the unit with a section cutaway.

As shown in FIGS. 1-3, the internal structure 26 of the vehicle impact barrier unit 10 comprises a spindle member 24 and a bottom structure 14. The bottom structure 14 is of a sufficient weight or mass, such that the vehicle impact barrier unit 10 has a relatively low centre of gravity. An impact force, from a large vehicle, for example a 7.5 tonne lorry (not shown) travelling at speed, will cause the vehicle impact barrier unit 10 to tip. The size of an optional embodiment of vehicle impact barrier unit 10 relative to an average adult human being is shown in FIG. 5. As the vehicle impact barrier unit 10 tips, the bottom structure 14 is at least partially lifted off the ground G. The bottom structure 14 is optionally configured and arranged to interfere with an inbound, impacting vehicle, such as a lorry. More particularly, but not exclusively, the bottom structure 14 is arranged to attach to, hook onto, damage, impede or otherwise disrupt one or more portions of the impacting vehicle, for example, an undercarriage, engine block, wheels and/or tyres thereof.

Unlike existing planters and bollards that are robustly affixed to the ground and which prevent the passage of a vehicle into a building by providing a rigid barrier that in some way absorbs the impact force of the vehicle, the vehicle impact barrier units 10 of the present invention are arranged to be free-standing. In other words, the vehicle impact barrier units 10 are not robustly affixed to the ground are not intended to withstand an impact from a lorry by remaining in their place of installation and absorbing that vehicular impact. Instead and very beneficially, the linked units 10 prevent passage of a vehicle by one or more or a combination of: the tipping of one or more units 10 which allows the bottom structure(s) 14 thereof to attach, damage or otherwise impede the lorry; and the collective mass of the linked units 10 arresting the lorry. Whether the lorry first impacts a unit 10 or a linkage means 30, 32, the system 100, being free-standing allows the linked units 10 to move. In response to the impact of a lorry attempting to drive through the barrier provided by the system 100, the chained units 10 will be pulled or drawn around the lorry, providing a massive drag against the lorry. Thus, the lorry is slowed by the weight of the units 10 dragging against the lorry; and at the same time may be impeded by the bottom structures 14 of one or more units 10 attaching onto and possibly causing actual and critical damage to the lorry, such that the lorry is halted. In this way a short-term, temporary event being held in a location not regularly used to host crowds of people, for example a music festival in a field, or a festive market assembled in roads that are temporarily closed off to traffic (but which normally allow the free passage of traffic), can be protected by the system 100 from a vehicle borne attack.

The system 100 may be assembled in a number of ways and although in FIGS. 3 and 5 vehicle impact barrier systems 100, 100' are shown wherein each unit 10 is of an identical and symmetrical form, linked by two linkage means, with uniform spacing between each unit 10, in a straight line, in other embodiments the system may comprise:

- one or more differently styled, shaped, sized or configured units 10; and/or
- adjacent units may be linked by less or more than two linkage means; and/or
- the linkage means may attach adjacent units at different locations, for example, a linkage means may attach to an upper portion of a first unit and to a lower portion of an adjacent second unit such that the linkage means is "on the diagonal" or otherwise angled; and/or
- the spacing between adjacent units may not be uniform such that two or more units 10 in the system have a greater or smaller spacing therebetween than two or more other units; and/or
- the units and linkage means may be arranged in shapes, lines or arrangements other than a mere straight line as shown.

Referring now to FIGS. 1 and 2, a first illustrated embodiment, of an optional form of a vehicle impact barrier unit 10, will be described. The outer shell 12 is generally bell-shaped, hollow structure with a substantially circular base 16. A first aperture 12*a* is provided at a top region and a second aperture 12*b* is provided in the base 16. The first and second apertures 12*a*, 12*b* are each shaped and sized to receive part of the internal structure 26. In this arrangement, the first and second apertures 12*a*, 12*b* are both square-shaped. In this arrangement, the outer shell is formed by moulding and may be made of strong plastics material, for example polyethylene. The height '$H_s$' of the outer shell 12 may be in the range of about 1.2 m to about 1.7 m and optionally may be about 1.5 m. The outer shell 12 may have a mass of about 30 kg to about 40 kg and optionally may be about 35 kg.

The internal structure 26 comprises a first spindle member 24 that is optionally centrally disposed within the outer shell 12. The first spindle member 24 optionally has a rectangular or square cross-section and is hollow. In other arrangements, the first spindle member 24 may have a different cross-sectional shape, for example, circular or triangular and/or may have a solid construct. The internal structure 26 and/or first spindle member 24 may be made of steel. Other suitable materials may be used for forming the first spindle member 24 and the internal structure 26. At a first, upper end of the first spindle member 24, an upper fixing member 18 is provided. The upper fixing member 18 comprises a top plate 18*a*, and a generally square or rectangular base plate 18*b*. One or more, optionally four coupling elements 20*a*, 20*b*, 23*a*, 23*b* are affixed to the top plate 18*a*. One or more or all of the coupling elements 20*a*, 20*b*, 23*a*, 23*b* may be used for attaching one or more first linkage means 30 to internal structure 26 of the unit 10.

The internal structure 26 further comprises the bottom structure 14. The various elements or components of the bottom structure 14 may all be formed from metal, for example steel, of a suitable thickness, and may be welded and/or mechanically fixedly attached together. In FIG. 2 the various components of the bottom structure 14 can be seen more easily. The bottom structure 14 comprises a second spindle member 24*b*, optionally having a circular cross-sectional shape and a hollow structure. The second spindle member 24*b* may be sized to fit within at least a section of the first spindle member 24. In other words, the second spindle member 24*b* has an external diameter that is just less than the internal diameter of the first spindle member 24. Corresponding apertures in the first and second spindle members 24, 24*b* allow the first and second spindle members 24, 24*b* to be attached. In other arrangements, a single spindle member 24*b* may be used instead of the first and second spindle members 24, 24*b*.

A series of spoke plates 44 project radially from the second spindle member 24*b*. Optionally in the present arrangement, eight spoke plates are provided at equal angular spacing and of equal length. The spoke plates 44 are each substantially planar in form. Adjacent spoke plates may be coupled together by web elements 46, also planar in form. The eight spoke plates 44 and eight web elements 46 may be formed as a single piece of metalwork. Depending from each spoke plate 44 is a fin 22*a*, 22*b*, 22*c*, 22*d*, 22*e*, 22*f*, 22*g*, 22*h*. Each fin 22*a*, 22*b*, 22*c*, 22*d*, 22*e*, 22*f*, 22*g*, 22*h* is of a similar form and therefore only one will be described in greater detail. The fin 22*d* is a generally planar metal piece having an internal side edge shaped for mating against the first and second spindle members 24, 24*b*. An aperture in the fin 22*d* enables a connecting means 20*d* to be affixed thereto. The connecting means 20*d* may have a rod and a loop and may be used for attaching a linkage means 32 to the bottom structure 14. The fin 22*d* comprises a top edge which is welded, bonded and/or mechanically and/or otherwise affixed to an underside of a corresponding spoke plate 44. The fin 22*d* comprises a first bottom edge 23*a*. In normal use, the unit 10 will be seated upon this first bottom edge 23*a* and upon a central bottom plate 42. A second bottom edge 23*b* is provided at an angle relative to the first bottom edge 23*a*. Optionally the angle is between about 120° and about 160°, and preferably may be about 150°. If the unit 10 is caused to tip, it may be seated, temporarily at least, upon the second bottom edge 23*b*. An external side edge 23*c* is provided, generally opposite the internal side edge and at an angle relative to the second bottom edge 23*b*. The angle between the second bottom edge 23*b* and the external side edge 23*c* may be between 120° and about 150°, and preferably may be about 130°. If the unit 10 is tipped further, it may be seated, temporarily at least, upon the external side edge 23*c*. The provision of eight angularly arranged radially extending spoke plates 44 and fins 22*a*, 22*b*, 22*c*, 22*d*, 22*e*, 22*f*, 22*g*, 22*h* provides a bottom structure 14 for a unit 10 that has a low centre of mass, that can be pushed or tipped in any direction yet will not overbalance and fall onto its outer shell 12, and which is biased to return to its normal, at rest position, because of the weight of the bottom structure 14 that would be raised off the ground G, when the unit 10 is tipped.

In some embodiments, the bottom structure 14 is formed entirely of metal, for example, steel and may have a mass of between about 260 kg and about 330 kg, and preferably about 300 kg. Optionally the mass of the outer shell 12 may account for only about 10% of the overall mass of the unit 10, with at least 90% of the mass of the bottom structure being well below half the height of the overall unit. In this way, the unit 10 has a low centre of mass; and when the unit 10 is tipped, a considerable portion of the weight of the bottom structure 14 is lifted off the ground G, which urges the unit 10 back to its normal upright position and makes it extremely difficult indeed, for the unit 10 to be tipped right over (such that its shell 12 was on the ground). The provision of the angled second bottom edges 23*b* further resists against tipping the unit 10 over. The height of the bottom structure 14 (i.e. excluding the first and second spindle members 24, 24*b*) may be in the range of about 0.5 m to about 0.7 m and optionally may be about 0.6 m.

As shown in FIG. 1, the base plate 16 of the outer shell 12 sits on top of the spoke plates 44 of the bottom structure 14, with the first and second spindle members 24, 24*b* extending through the second aperture 12*b*. The first spindle member 24 extends through the first aperture 12*a*; and the upper fixing member 18 is provided on top of the first spindle member 24. In this way, the vehicle impact barrier unit 10 is assembled. The system 100 is assembled simply by linking adjacent units 10 together using upper and lower linkage means 30, 32 (see FIG. 3). The upper linkage means 30 may be longer than the lower linkage means 32. coupling elements 20*a*, 20*b*, 23*a*, 23*b* on the upper fixing member 18 may be used along with connections 33 to connect the linkage means 30 to the fixing members 18 of two adjacent units 10. Similarly, connecting means 20*c*, 20*d* on one of the fins 22*a*, 22*b*, 22*c*, 22*d*, 22*e*, 22*f*, 22*g*, 22*h* may be used, along with connections 33, to connect the linkage means 32 to a fin 22*a*, 22*b*, 22*c*, 22*d*, 22*e*, 22*f*, 22*g*, 22*h* of an adjacent unit 10. Optionally the minimum spacing between the widest parts of adjacent units (see 'W' in FIG. 3, may be in the region of 1.2 m. It will be understood that other spacings or pitches may be suitable and the minimum spacing of 1.2 m indicated here is provided merely to indicate the size and possible configuration of the system 100 and its suitability for stopping a vehicle borne attack.

Figure 4A:
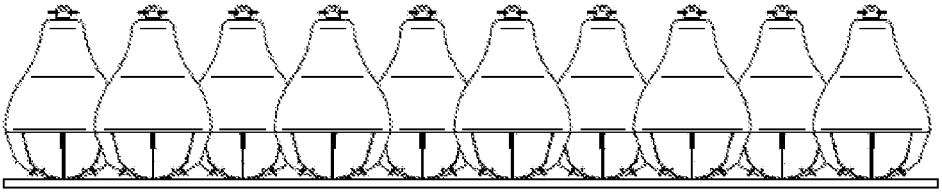
FIGS. 4A, 4B, 4C show front plan, top plan and perspective views of an arrangement of units of FIG. 1, in preparation for being transported to site and assembled into a system.
Figure 4B:
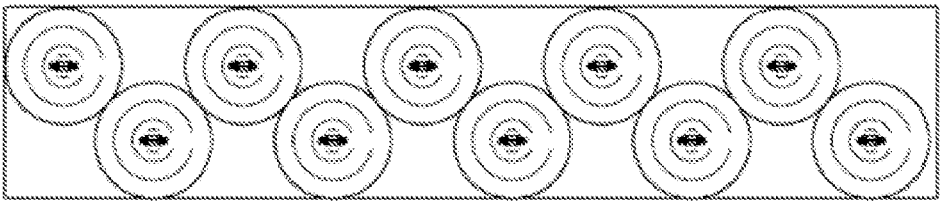
Figure 4C:
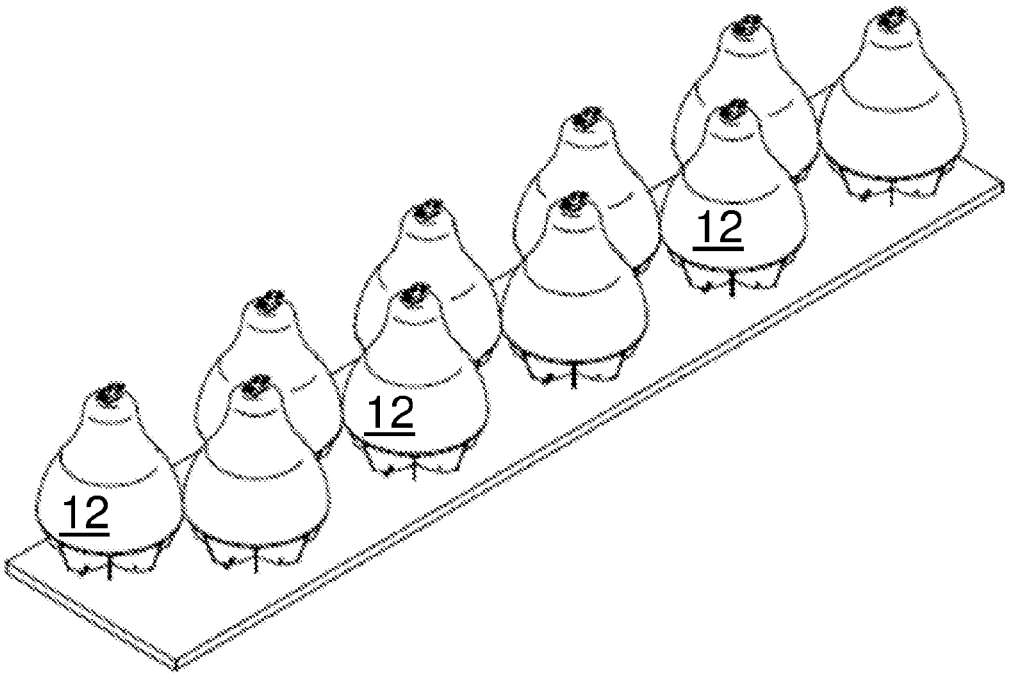

The units 10 are of a considerable size and weight and, for example, their transportation to a site for temporary assembly of the system 100, may be facilitated by a low loader. Beneficially, and as illustrated in FIGS. 4A, 4B, 4C, fully assembled units 10 can be nested efficiently such that ten units 10 could be transported by a single vehicle. Whilst the priority in preventing a vehicle born attack is not minimising transportation costs, the suitability for transportation of multiple units 10 further illustrates the benefits provided by the system 100. Where the units 10 are of a different shape or size to that shown, fewer or greater units 10 may be transported by a single delivery vehicle. Depending upon the site to be protected more of fewer than ten units 10 may be needed in the assembled system 100.

Referring now to FIGS. 5 and 6, 7 and 8, and 9 to 11, there are shown additional embodiments of the vehicle impact barrier units and system of the present invention. In the alternative illustrated embodiments, like numerals have, where possible, been used to denote like parts, albeit with the addition of the prefix "100" "200" and "300" to indicate that these features belong to the additional embodiments respectively.

Figure 6:
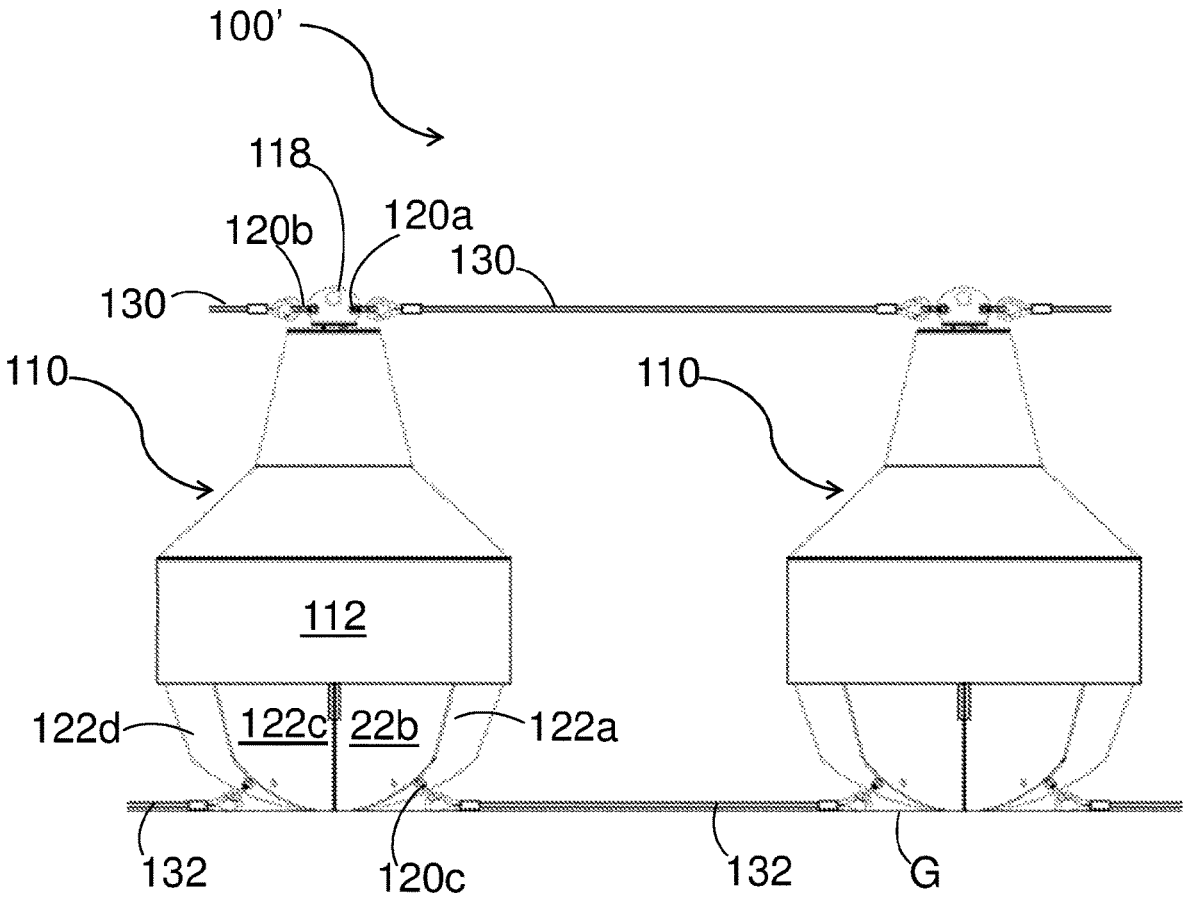
FIG. 6 is an enlarged view of a section of the system of FIG. 5.

In FIG. 5 a system 100' is illustrated wherein nine units 110 have a differently shaped and formed outer shell 112 (see FIG. 6). The scale of the system 100' is illustrated in FIG. 5 by the presence of a person P. It can be seen that people can pass uninhibited between adjacent units 110. Simply stepping over the lower linkage means 132 which rests upon the ground G. The units 110 are not attached or affixed to the ground G and are free standing. Should a vehicle attempting to breach the protective barrier provided by the system 100' attempt to drive through the line of linked units 110, at least one unit 110 would tip and potentially engage its bottom structure onto the attacking vehicle, possibly causing damage thereto, and other units would wrap around the attacking vehicle dragging to a stop owing to their collective weight.

As shown in FIG. 6, the units 110 have a differently shaped outer shell 112. This outer shell 112 may not be moulded, but may be a fabricated structure that is assembled out of a series of panels.

Figure 7:
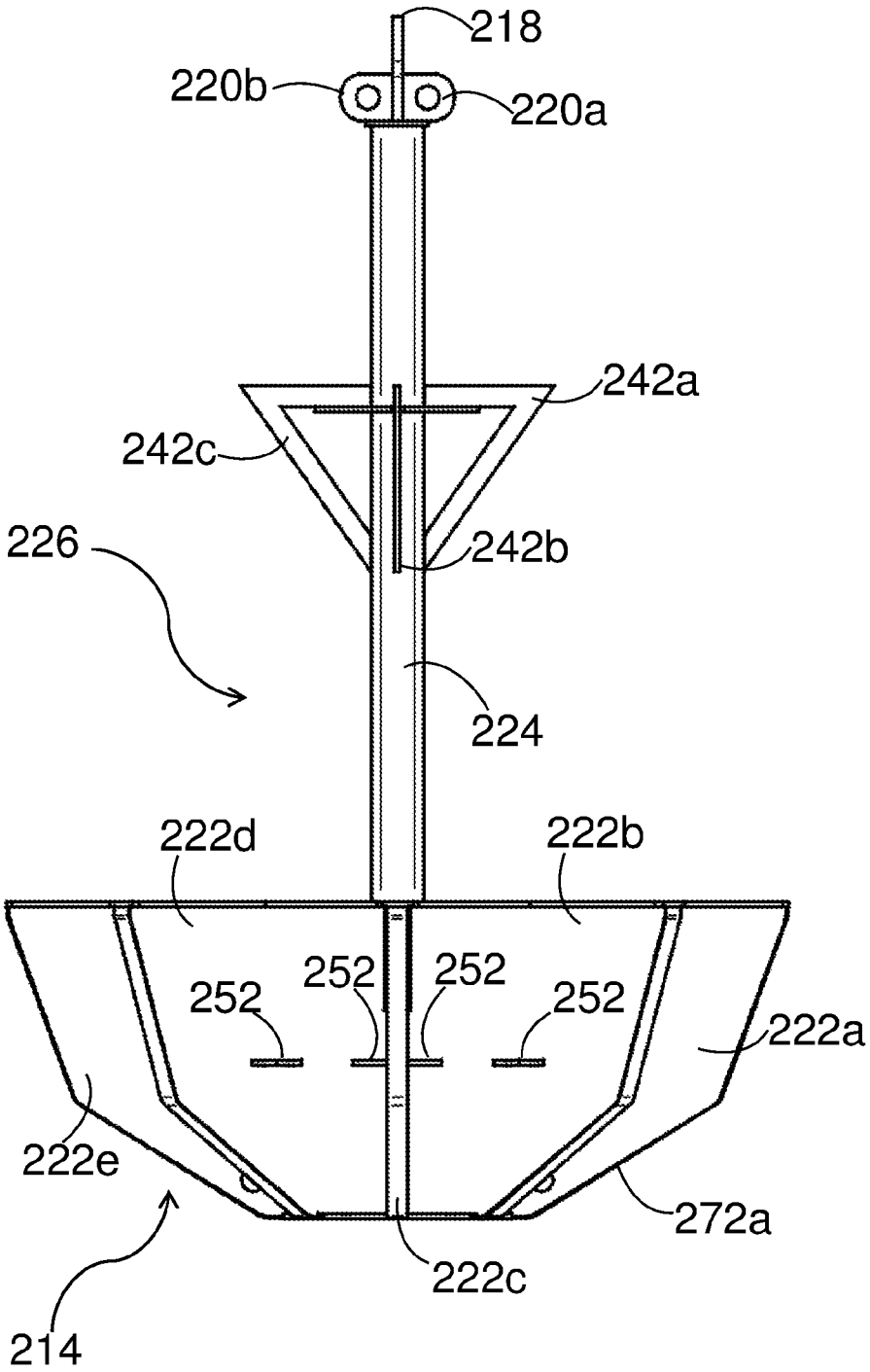
FIG. 7 is a front plan view of an internal structure of a vehicle barrier unit according to yet another embodiment of the invention.
Figure 8:
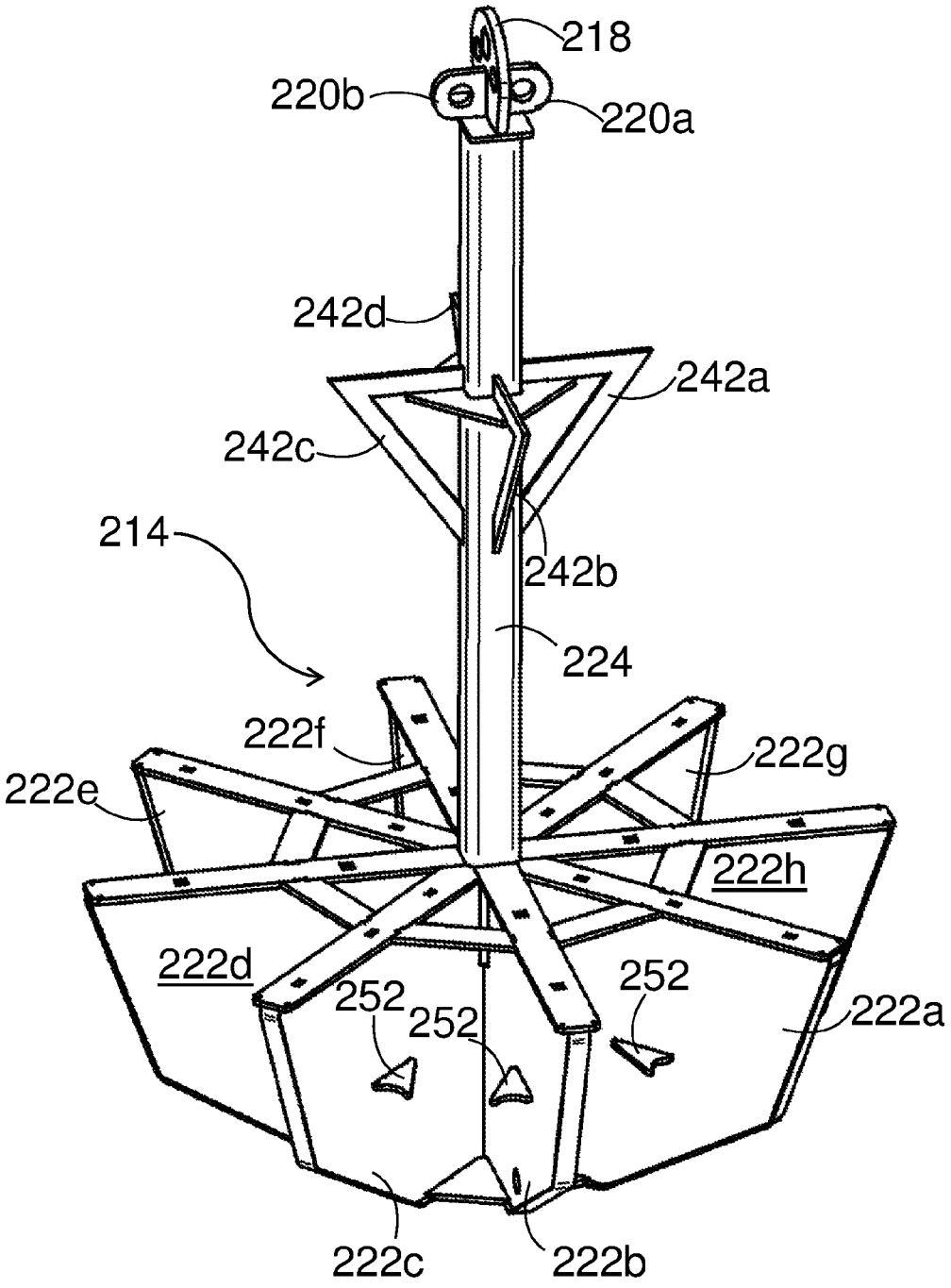
FIG. 8 is a perspective view of the internal structure of FIG. 7.

In FIGS. 7 and 8 an internal structure 226 according to various embodiments and suitable for use with the outer shells 12, 122 of FIGS. 1-6 is shown. Attached to the first spindle member an optional arrangement of anchor members 242*a*, 242*b*, 242*c* are provided. Additionally, or alternatively, a series of teeth 252 project from the surfaces of the fins 222*a*-222*h*. As a vehicle drives into the unit 10, 110, the internal structure 226 may be rotated such that a wheel or tyre of the vehicle goes between two fins 222*a*-222*h*. Should a unit 10, 110 be tipped or bowled over onto its side on the ground G by an attacking vehicle, then one or more of these anchor members 242*a*, 242*b*, 242*c* and or teeth 252 may act to puncture a tyre or otherwise anchor the internal structure 226 to and/or cause damage to the attacking vehicle.

Figure 9:
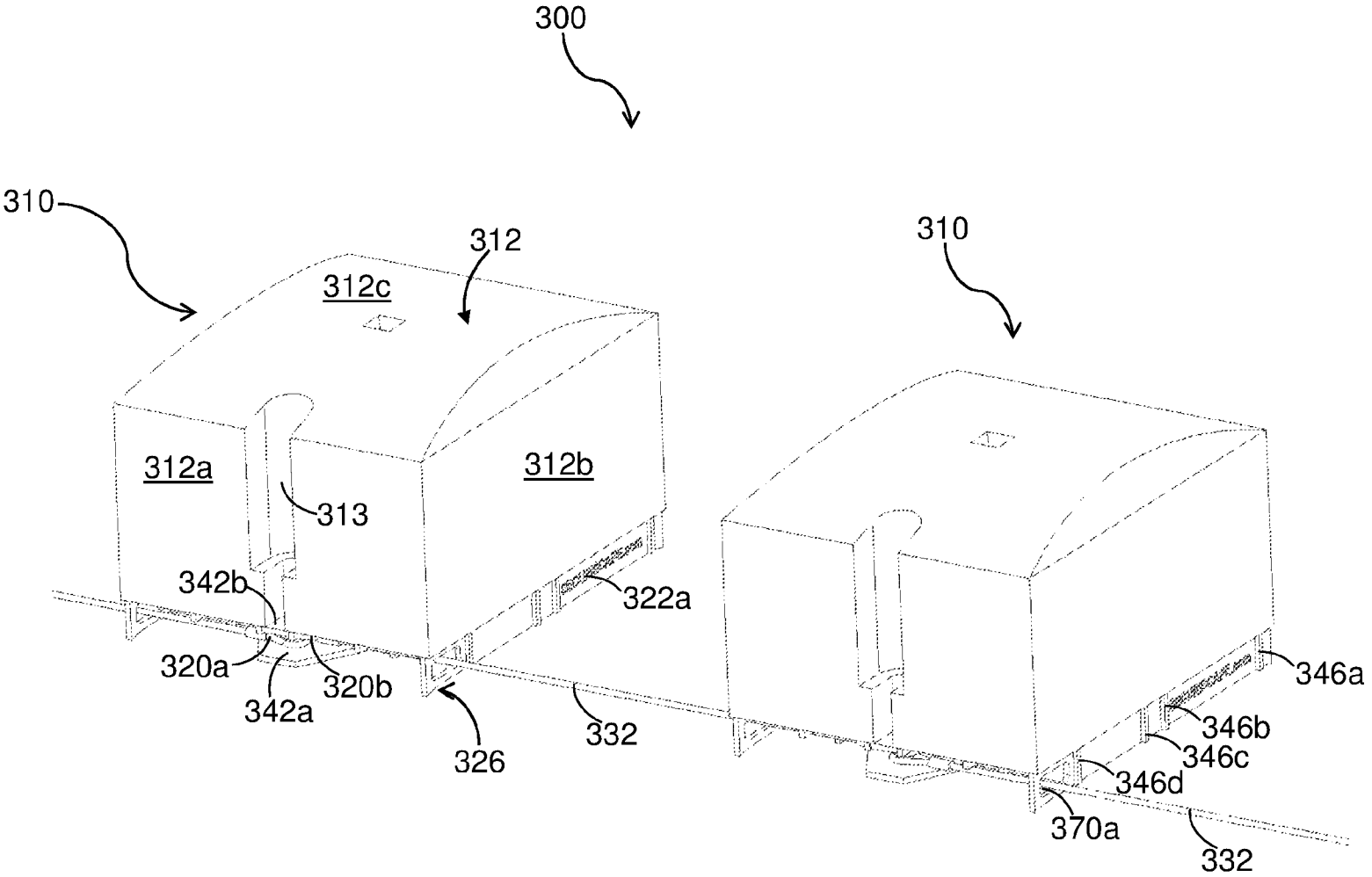
FIG. 9 is a perspective view of a vehicle impact barrier unit according to various other embodiments of the invention.

Referring to FIG. 9 there is shown a vehicle impact barrier system 300 according to various embodiments comprising a series of impact barrier units 310 and at least one linkage means 332. As with the earlier embodiments a free-standing first impact barrier unit 310 is linked to at least one other impact barrier unit 310 by the at least one linkage means 332. In contrast to the earlier embodiments, in the arrangement illustrated in FIGS. 9-11, the at least one linkage means 332 comprises only a first linkage means coupled to a lower portion of the first impact barrier unit 310 and coupled to a lower portion of the second impact barrier 310. No "upper" linkage means is provided.

Figure 10:
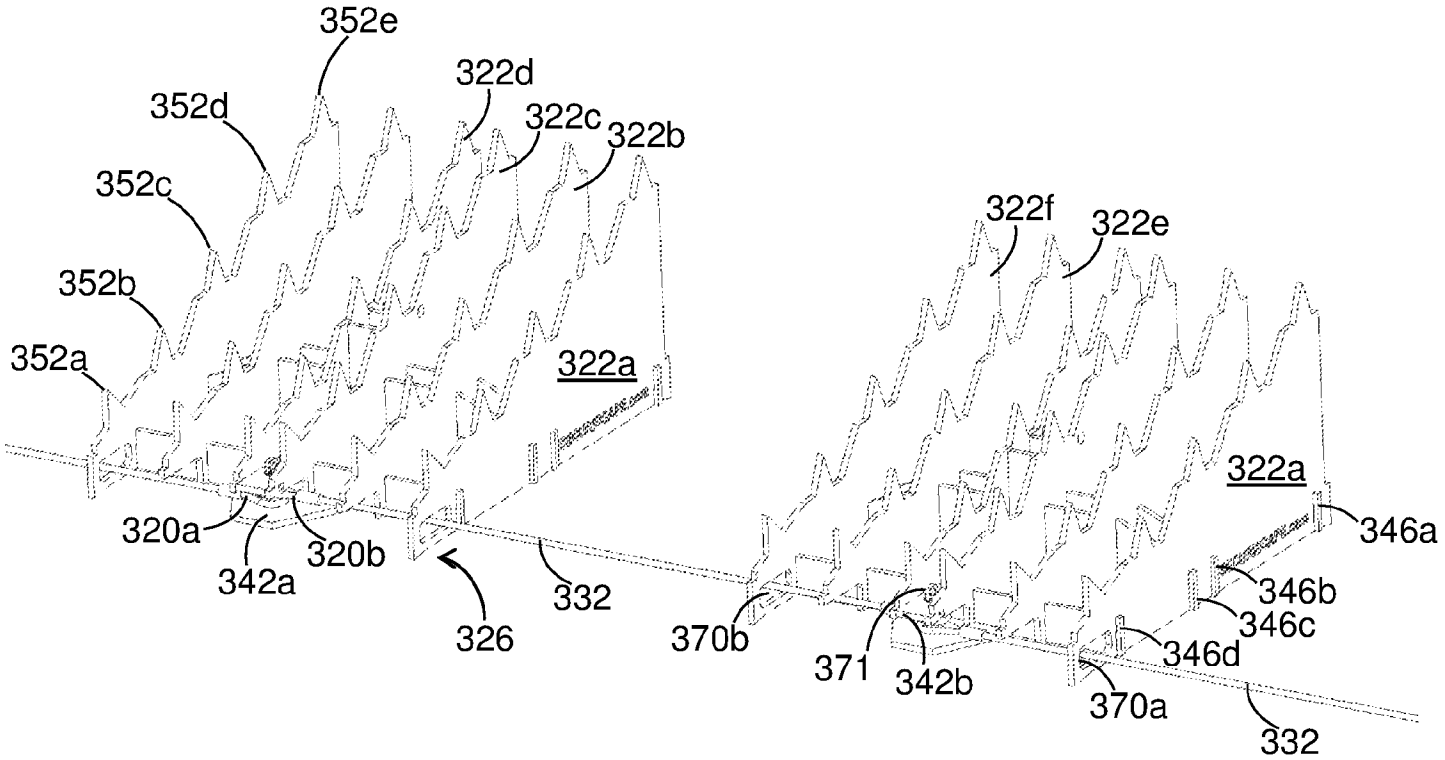
FIG. 10 is a perspective view of the internal structure of a vehicle impact barrier as shown in FIG. 9.
Figure 11:
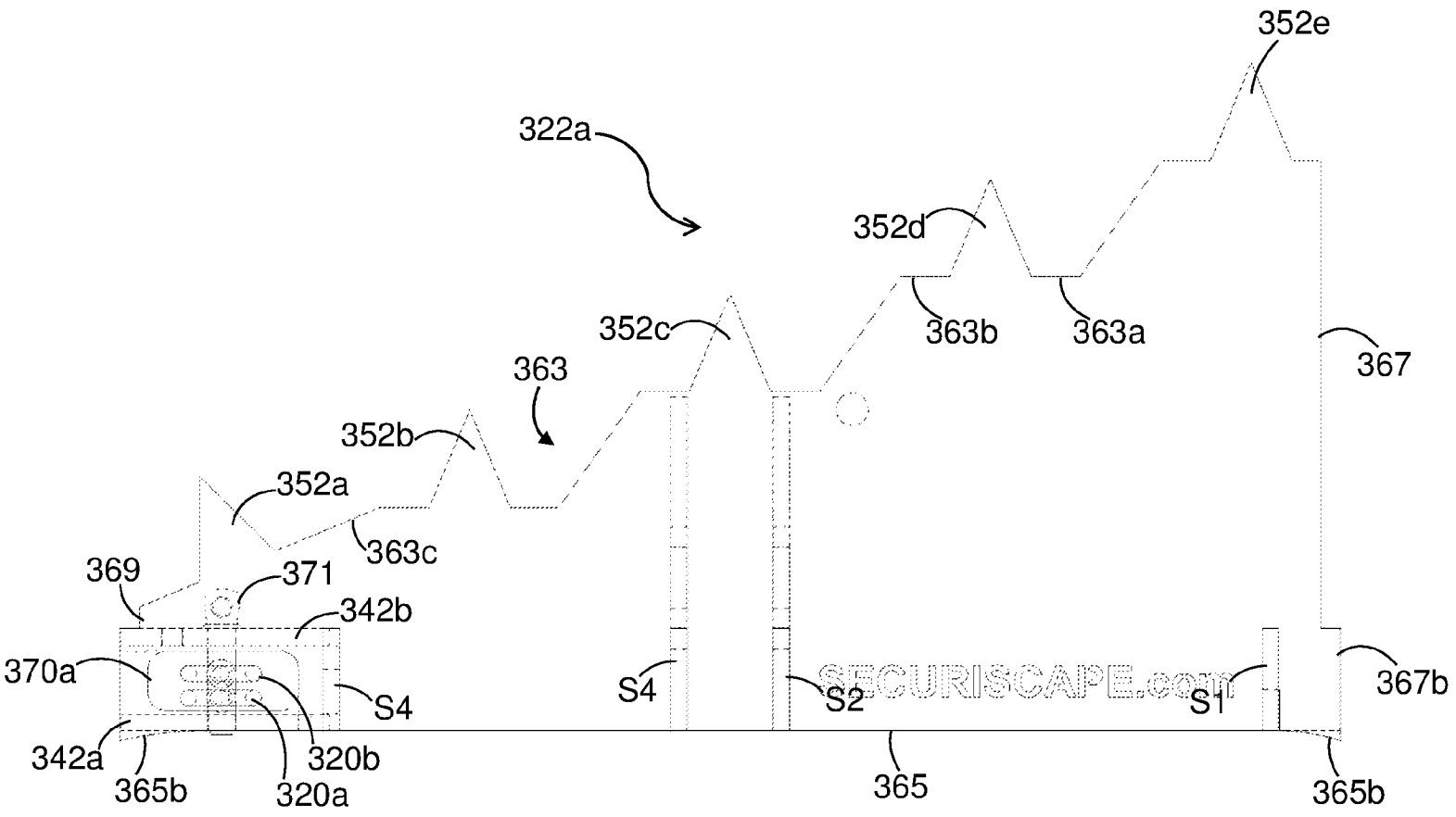
FIG. 11 is a plan view from the side of a fin or blade forming part of the internal structure of FIG. 10, wherein some features that would not necessarily be seen in this view are shown in dotted outline to illustrate the position of those parts relative to the fin of the internal structure.

As shown in FIGS. 9 to 11, each impact barrier unit 310 comprises an outer shell 312 and an internal structure 326. The internal structure is best seen in FIG. 10 wherein the system 300 is illustrated without the outer shells 312 on each of the first and second impact barrier units 310.

Though the impact barrier units 310 of the present arrangement are not limited to any specific dimensional arrangement, size or maximum height, unlike in the earlier embodiments, the internal structure 326 does not have a spindle member and the internal structure 326 may be considered as all being comprised of a bottom structure 326. The impact barrier units 310 comprise an outer shell 312 that optionally fits closely about the internal structure 326 such that "bottom internal structure" 326 fills the majority of the outer shell 312. The internal structure 326 is sized, arranged and configured such that the impact barrier unit 310 has a progressive series of "impact points" which can engage, interact with or otherwise interfere with vehicles of different size and/or with different parts of a vehicle. It will be recognised that vehicles range in size from large haulage trucks down to smaller cars. The ground clearance between a bottom most part of the chassis, body or engine of vehicles also varies between vehicles. Additionally, the ground clearance between different parts of a vehicle vary, for example, the ground clearance to the bottom of a front bumper and the ground clearance to the underside of an engine, and the ground clearance to the bottom most part of a chassis may vary. Accordingly, the impact barrier units 310 are configured and structured such that they can arrest a variety of sized vehicles and optionally do so by interfering with a vehicle at one, or more different locations on the vehicle.

As shown in FIG. 9, the outer shell 312 is generally rectangular in shape, optionally having a slightly domed top surface 312*c* and substantially planar front, rear, first and second side walls 312*a*, 312*b*. The front wall 312*a* and rear wall may be similarly dimensioned. The rear wall may alternatively have a greater height than the front wall.

At the front, the outer shell 312 optionally comprises an elongate channelled region 313, which is provided to assist with the location of a locking bolt 371 which locks first and second linkage means 332 together (see FIG. 10). The elongate channel 313 is optional—access to the locking bolt 371 may be provided by alternative means, or the size and shape of a channel that provides access to the locking bolt 371 may be differently sized and shaped to that shown. It is anticipated that in some arrangements the channel region 313 may be significantly shorter than that shown.

Optionally, the outer shell 312 is not fully co-extensive with the internal structure 326 and may not comprise a complete shroud over the internal structure 326. In other words, a bottom portion of the internal structure 326 may extend beyond the lowest edges of the outer shell 312 as shown in FIG. 9.

As described above, the internal structure 326 is arranged to provide multiple points of engagement, at different heights above ground level. The internal structure 326 is best illustrated in FIG. 10, where it can be seen that a series of fins 322*a*, 322*b*, 322*c*, 322*d*, 322*e*, 322*f* are provided. A first fin 322*a* is shown in side plan view in FIG. 11. The first fin is an end-most fin 322*a* of the internal structure 326 (see FIG. 10). It is optional that six fins are provided 322*a*, 322*b*, 322*c*, 322*d*, 322*e*, 322*f*. In other arrangements a greater or lesser number of fins 322*a*, 322*b*, 322*c*, 322*d*, 322*e*, 322*f* may be utilised.

As shown, first fin 322*a*, has a front edge 369 and a rear edge 367. The rear edge 367 has a greater height than the front edge 369 and the first fin 322*a* has a general similarity to the shape of a right-angled triangle. The first fin 322*a* has an upper edge 363 (see FIG. 11). The upper edge follows a generally diagonal path extending between the front edge 369 and rear edge 367 and is interrupted by a series of anchor members, projections or teeth, 352*a*, 352*b*, 352*c*, 352*d*, 352*e*. The series of anchor members may comprise, as shown, five projecting teeth 352*a*, 352*b*, 352*c*, 352*d*, 352*e*, that may be triangular in shape and substantially planar. The teeth project from the upper edge 363, such that the upper edge comprises a series of plateaus 363*a*, 363*b* and peaks (anchor members 352*a*, 352*b*, 352*c*, 352*d*, 352*e*). Optionally a leading or front most tooth 352*a* that is disposed lower most and front most may project from an angled section 363*c* of the upper edge 363. Optionally, the angled section may be inclined at an angle of between about 15° and about 30°. Preferably, the angled section may be inclined at an angle of about 20°. In this way, the leading or front most tooth 352*a* points in a slightly more forward direction compared to the other teeth 352*b*, 352*c*, 352*d*, 352*e* in the series. This may offer the optional benefit of enabling the front-most tooth to engage or anchor onto an underside component or portion of an incoming vehicle, either because of the vehicle impacting that anchor member 352*a* first, or because of the vehicle impacting a higher anchor member 352*b*, 352*c*, 352*d*, 352*e* in the series causes the impact barrier unit 310 to rock or pivot upwardly (as described further below), thus rotating the leading or front most tooth 352*a* into the incoming vehicle.

As shown in FIG. 11, the first fin 322*a* has a bottom edge 365 that is generally a straight edge and provides a base; however, the bottom edge 365 comprises at least one gripping member 365*a*, 365*b*. Optionally, two, gripping members 365*a*, 365*b* are provided by a first gripping member 365*a* proximate a front end of the bottom edge 365 and a second gripping member 365*b* proximate a rear end of the bottom edge 365. The first and second gripping members 365*a*, 365*b* are optionally both provided as integrally formed shaped portions of the first fin 322*a*. In other arrangements, the at least one gripping member may be provided by an added feature or component attached or affixed to the fin 322*a*.

Each gripping member 365*a*, 365*b* is a relatively short, slightly curved ramped portion with a pointed or sharp edge for gripping. The first gripping member 365*a* is formed as a tapered and pointed extension to the front edge 369. The front edge 369 extends beyond the general line of the bottom edge 365 and then ramps towards the bottom edge 365. As such, the first gripping member 365*a* has a wedge-shaped appearance, albeit its surface may be flat or curved and the front edge of it may be pointed sharply downwardly toward the ground level. Similarly, the second gripping member 365*b* is formed as a tapered and pointed extension to the rear edge 367. The rear edge 367 extends beyond the general line of the bottom edge 365 and then ramps back up towards the bottom edge 365. As such, the second gripping member 365*b* has a wedge-shaped appearance, albeit its surface may be flat or curved and the rear edge of it may be pointed sharply downwardly toward the ground level.

A heel portion 367*b* projects out of the general line of the rear edge 367. The heel portion 367*b* leads into the second gripping means 365*b*. The heel portion 367*b* is of a similar height to the height of slots S1, S2, S3 and S4 and in use provides and edge or shelf, upon which the outer shell can sit. This stops the outer shell from providing a complete shroud over the internal structures 326 and allows a fork-lift or other suitable lifting equipment to place gripping tools into the internal structure 326 for lifting the unit 310.

The first fin 322*a*, like the last fin 322*f* comprises an aperture 370*a*. The aperture 370*a* is provided for receiving part of a linkage means 332 (see FIG. 10). The aperture 370*a* is optionally generally rectangular with rounded corners, and is of sufficient dimension that when the system 300 is assembled, the linkage means 332 threaded therethrough does not necessarily contact any of the internal edges of the aperture 370*a*. In other arrangements, the aperture may be differently shaped and may even be dispensed with. It is optional to have the aperture 370*a*, which serves as a second location that the linkage means 332 is coupled to a unit 310. However, this second location for connection may be omitted or may be achieved by another suitable means. In total, each linkage means 332 is coupled in three places within the system 300 and this helps to prevent twisting.

As shown in FIG. 10, the internal structure 326 of each unit 310 comprises a series of transverse members, in this case four transverse member 346*a*, 346*b*, 346*c*, 346*d*. The fin 322*a* comprises a plurality of slots, in this case, four slots S1, S2, S3, S4, each sized and positioned for receiving part of a transverse member 346*a*, 346*b*, 346*c*, 346*d* (see FIG. 11). The slots S1, S2, S3, S4 as shown extend to the bottom edge 365 of the first fin 322*a* such that the first fin 322*a* can be slotted, by relative movement between the transverse members 346*a*, 346*b*, 346*c*, 346*d* and the first fin 322*a*, and then affixed thereto, optionally by welding.

Other suitable affixing methods and means may be used in addition to welding, for example, mechanical fasteners may also be utilised.

The fins of the series of fins 322*a*, 322*b*, 322*c*, 322*d*, 322*e*, 322*f* are similar in construct to the first fin 322*a*, albeit, only the first fin 322*a* and last end fin 322*f* have apertures 370*a*, 370*b*, whereas the fins 322*b*, 322*c*, 322*d*, 322*e*, therebetween have a recessed portion so that the linkage means 332 only has to be threaded through two apertures 370*a*, 370*b* (one a first unit 310, and one on a neighbouring unit 310). In this way, each linkage means 332 has three coupling locations within the system 300, yet remains relatively easy, simple and quick to install onsite.

The internal structure 326 additionally comprises a central bottom plate 342 which may comprise an aperture with an internal thread for receiving, locating and fastening the locking bolt 371. Optionally a further plate 342*b* is disposed between two fins 322*c*, 322*d* and affixed thereto and is disposed above the central bottom plate 342. The further plate 342*b* may comprise an aperture appropriately aligned relative to the internal thread in the bottom plate 342 such that the locking bolt 371 can be more securely held in place, and therefore more securely couple each of two linkage means 332 to the internal structure 326 of the unit 310 (see FIG. 10).

The fins 322*a*, 322*b*, 322*c*, 322*d*, 322*e*, 322*f* may be uniformly spaced or not. In the optional arrangement shown, the middle two fins 322*c* and 322*d* are closer together than the other fins and this is entirely optional.

The series of projecting teeth 352*a*, 352*b*, 352*c*, 352*d*, 352*e* similarly shaped, sized, positioned and arranged on each fin 322*a*, 322*b*, 322*c*, 322*d*, 322*e*, 322*f*. In this way, the internal structure 326 comprises a row of aligned teeth at each of five different heights, wherein the first, front most row 352*a*, has the lowest height above ground level, progressively increasing up to the last, rearmost row 352*e* which has the highest height above ground level.

To arrest an incoming vehicle, upon impact, the free standing, linked units 310 of the system 300 will engage the vehicle. The teeth of the appropriate row will contact an underside component (bumper, chassis, engine). A tall vehicle may hit the highest row of teeth 352*e* of at least one of the units 310, which will then rotate or pivot on impact, rotating the front end of the internal structure up underneath the vehicle so that the teeth in the front most rows can contact, engage, disrupt and otherwise interfere with the vehicle.

Upon vehicle impact, the first and second gripping members provided on the fins 322*a*, 322*f* may help to avoid the unit 310 being pushed out of the way by the vehicle and may grip, by digging into the ground surface, such that upon impact between the vehicle and a projecting tooth of the appropriate height for the vehicle, the vehicle pushing against that tooth, pushes a back-end of the internal structure 326 down towards the ground and the unit 310, in particular the internal structure 326 thereof is pivoted, with the front edge coming up such that other teeth may also engage the vehicle.

sized vehicle approaches a row of teeth will be at the appropriate height to engage the vehicle. Additionally, the weight of the units 310 will also help to slow the vehicle as a number of units in the system 300 wrap about the vehicle. As additional units come into contact with the vehicle their teeth may also engage with the vehicle which may cause sufficient damage to cause the vehicle to come to a stop and/or may enable a sufficient mass to drag about the vehicle, that is now enveloped or netted by the system 300, such that vehicle is arrested and sufficiently slowed or stopped. Even if a vehicle impacts a linkage means first, the units 10 attached thereto will be quickly gathered around the vehicle. The weight of the units in the system will drag on and slow the vehicle and as units come into contact with the vehicle the will still bite into an underside section or component and may rotate or pivot up underneath a side portion of the vehicle which will either cause critical damage, or a sufficient drag weight that the vehicle slows significantly or stops.

The units 310 of this embodiment may be stackable such that a greater number may be located on a flat-bed type delivery vehicle, this enabling the component parts of this system 300 to be delivered in a more cost-effective manner (per number of units) compared to the systems of the earlier embodiments.

Figure 12:
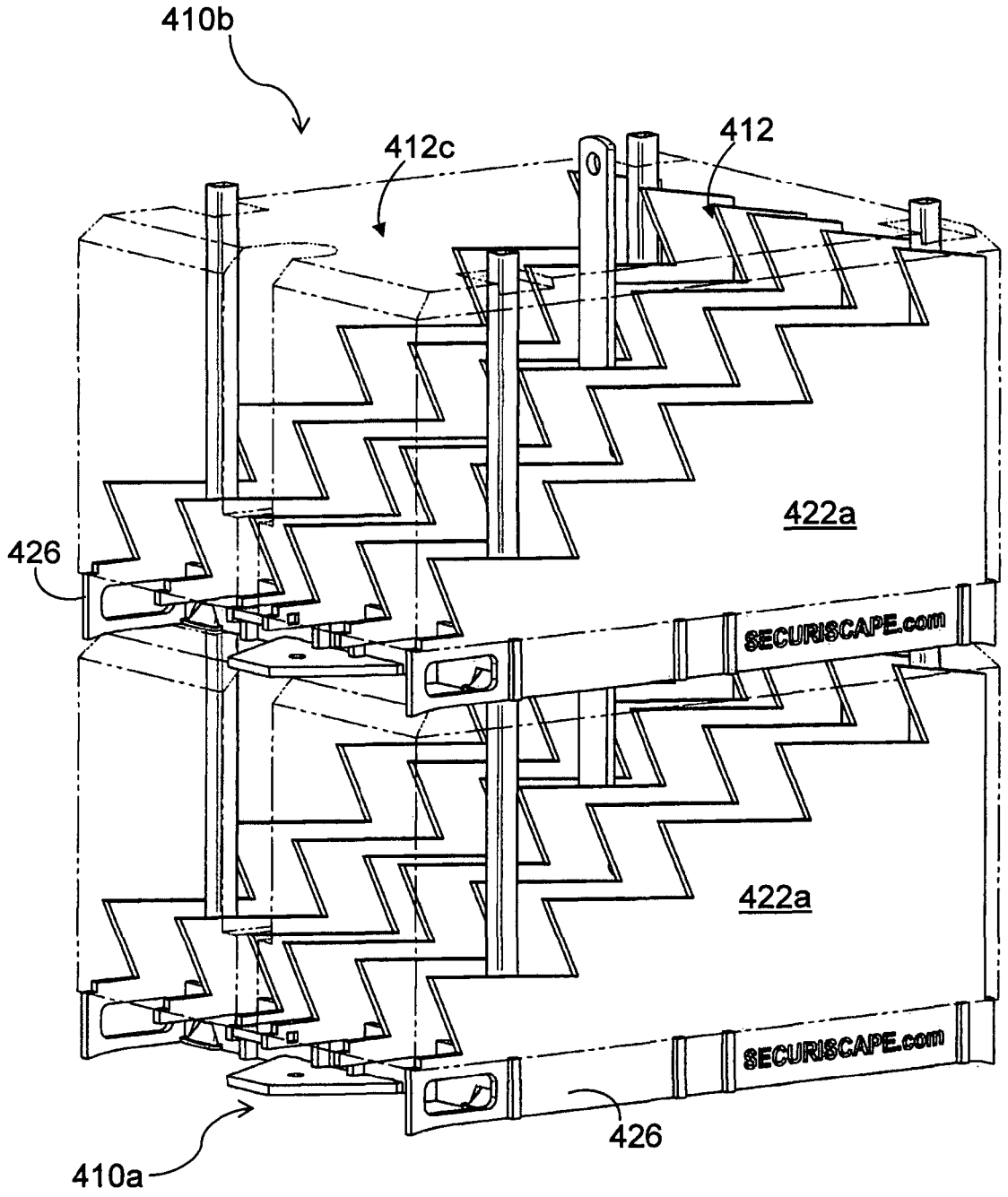
FIG. 12 is a perspective view of two vehicle barrier units according to yet another embodiment of the invention, stacked one on top of the other, ready for transportation, wherein the outer shell is shown in transparent view to illustrate the internal structures of each unit as well as a framework used to facilitate stacking the units.
Figure 13:
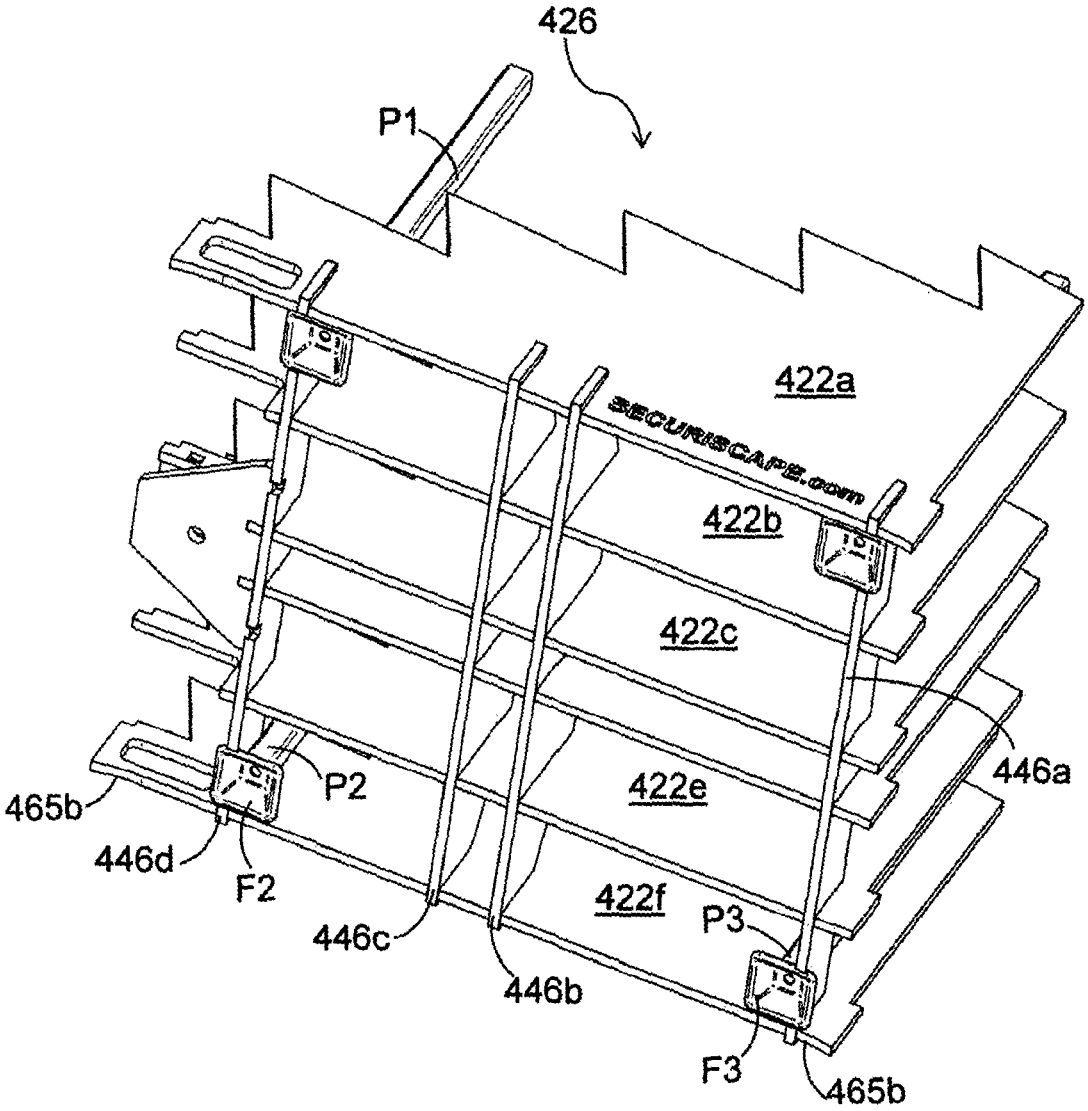
FIG. 13 is a perspective view from the bottom of the internal structure of one of the vehicle barrier units of FIG. 12, showing part of the framework.
Figure 14:
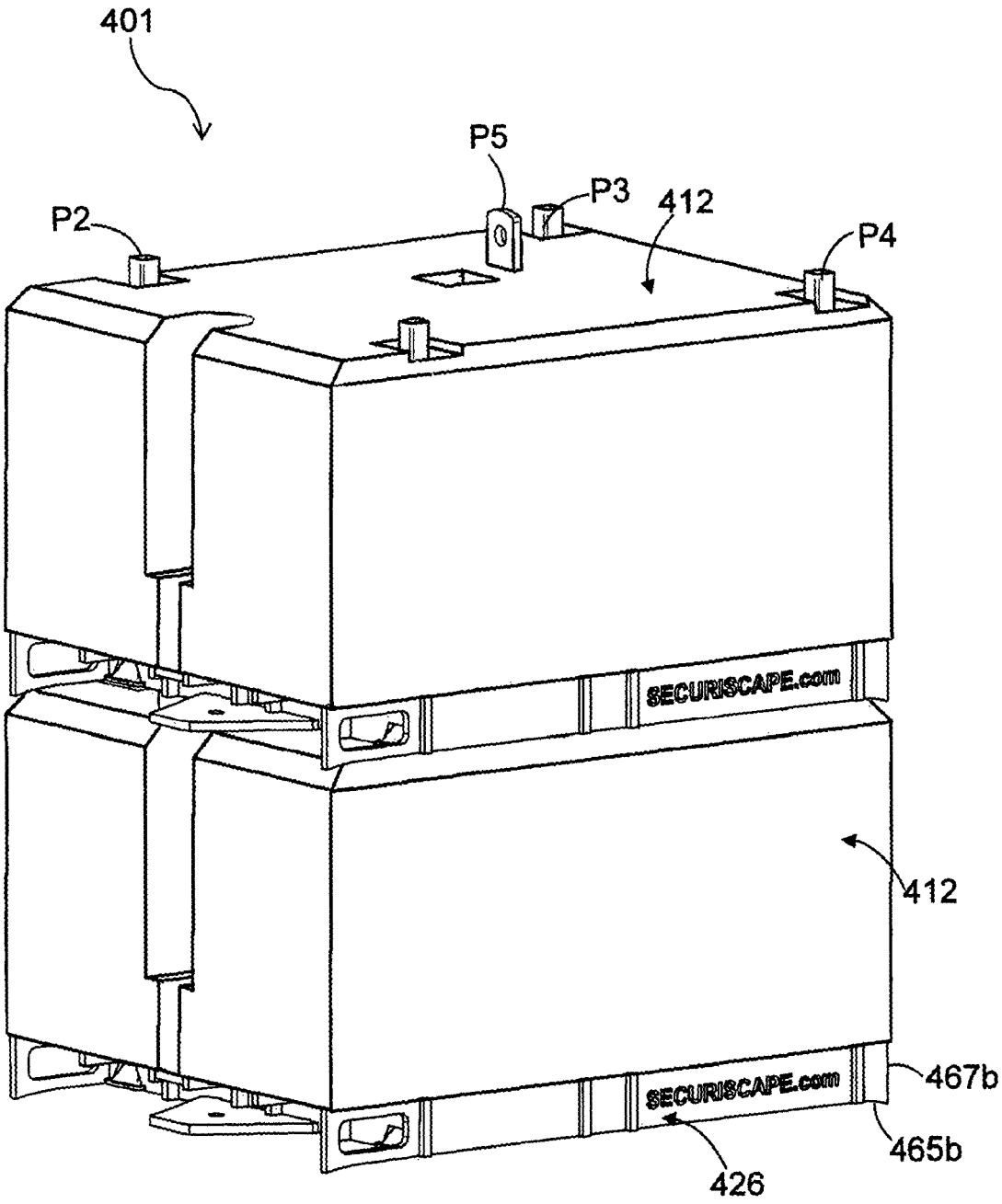
FIG. 14 is a perspective view similar to that of FIG. 12, wherein the outer shells of each unit are shown in solid colour and obscuring from view certain parts of the internal structures and frameworks

Referring now to FIGS. 12 to 14 there is shown yet a further embodiment of the vehicle impact barrier units for use in a system. In the alternative illustrated embodiments, like numerals have, where possible, been used to denote like parts, albeit with the addition of the prefix "400" to indicate that these features belong to this further embodiment.

The vehicle impact barrier units 410 are shown in FIGS. 12 and 14, stacked, one on top of another. In FIG. 12 a topmost unit 410*b* is stacked and sits on a bottom most unit 410*a*. The units are very similar to that of the embodiment of FIGS. 9 to 11 and indeed the internal structure 426 is the same. In this arrangement, and to facilitate stacking, the outer shell 412 is provided with one or more suitably shaped, sized and arranged apertures for receiving part of a framework therethrough. The framework is provided to allow for secure, safe and reliable stacking of one or more units, one on top of the next and to ensure that the units 410 are not damaged during transportation and can be securely tied down to a transportation vehicle, such as a flat-bed truck.

The framework may take a variety of forms. In FIGS. 12 to 14 an example of a suitable framework is illustrated. The framework optionally comprises one or more posts P1, P2, P3, P4, each having a foot F1, F2, F3 associated therewith. As shown best in FIG. 13, the internal shape of a foot F2, F3 is configured and sized such that it matches, is similar to, or otherwise co-operates with a corresponding post P2, P3 inserted into the unit below. In this way, the foot of a higher framework can nest, stack, or sit, onto the post of a lower framework, enabling the units 410, to be stacked without the weight of the internal structure of a higher unit 410*b* crushing, squashing or otherwise damaging the plastic outer-shell 412 of a lowermost unit 410*a*. Optionally the framework is structured such that a fork of a forklift truck can be inserted between fins 422*a*, beneath the outer shell 4112 and between posts P1-P4 of the framework so that the fork lift can lift a unit; stack a unit onto a flat-bed, stack another unit on top and similarly, onsite, unstack and unload the units. Beneficially, the ability to stack units may have a significant reduction in distribution costs compared to the units 10 of the first invention, because, for example, twice as many units 410 than units 10 may be fitted onto a flat-bed truck. Thus, reducing transport costs by a factor of two.

Additionally, the top of the outer shell 412 is optionally a flatter top wall 412*c*; the outer shell is optionally formed of plastic material, for example polyethylene and therefore, its shape and design can be changed and adjusted to suit a variety of purposes. For example, and as merely one of a range of options, a flatter top wall 412*c* allows the unit 410 to be utilised as a stand, mount or base for receiving another item, such as but not limited to, a planter or other decorative item. This may improve the aesthetic appeal of the vehicle impact barrier system and whilst providing necessary security against the serious threat of a vehicle borne attack, a unit coated in flowers, greenery or other decorative elements may be more aesthetically pleasing and rather than instilling a feeling of concern or panic at an obvious reminder of the threat of attack, may instill a feeling of calm in the people using a protected facility. By way of further example, the side walls and top wall of the outer shell could be colour co-ordinated, branded, decorated, utilised for marketing, advertising and other sponsorship or promotional graphics, indicia and logos.

It can be appreciated that various changes may be made within the scope of the present invention, for example, the size and shape of the units, outer shells and linkage means may be adjusted to produce systems of sufficient size, length and stopping power to accommodate different events or sites in need of protection from a vehicle borne attack. The size and shape of the teeth or anchoring members is not limited to being triangular and not all teeth may be the same shape. The height above ground of each row of anchoring elements may vary from that illustrated, albeit the illustration cannot be taken as necessarily being to scale.

In yet further envisaged arrangements, the internal structure may be arranged such that the unit can be used from either the front or rear end—in such an arrangement rows of anchoring members front most and rearmost may be the lowest, progressively increasing to the highest rows of teeth in the middle of the unit.

It will be recognised that as used herein, directional references such as "top", "bottom", "front", "back", "end", "side", "inner", "outer", "upper" and "lower" do not necessarily limit the respective components to such orientation, but may merely serve to distinguish these components from one another.

The invention claimed is:

1. A vehicle impact barrier system comprising a series of impact barrier units and at least one linkage means, wherein a first impact barrier unit is linked to at least one other impact barrier unit by said at least one linkage means, wherein the at least one linkage means comprises a first linkage means coupled to a lower portion of the first impact barrier unit and coupled to a lower portion of a second impact barrier, wherein each impact barrier unit comprises an outer shell and an internal structure, wherein the internal structure comprises a plurality of fins, wherein the internal structure comprises a series of rows of anchoring members, wherein the anchoring members of a first row are disposed at a different height above ground level compared to the anchoring members of a second row, wherein anchoring members project from each fin, wherein each fin has an upper edge that follows a generally diagonal path extending between a front edge and rear edge, said upper edge being interrupted by an anchoring member from each row of said series of rows of anchoring members such that the upper edge comprises a series of plateaus and peaks, wherein a leading or front most anchoring member of each fin is disposed lower most and front most, and projects from an angled section of the upper edge.

2. The system of claim 1 wherein the outer shell provides an incomplete shroud over the internal structure such that a bottom portion of the internal structure extends below lowest edges of the outer shell.

3. The system of claim 2 wherein the internal structure is arranged such that multiple of said anchoring members are disposed at two or more different heights above ground level and such that, in use, multiple of said anchoring members can engage with a vehicle.

4. The system of claim 3 wherein the impact barrier units are each free-standing and wherein the system is free-standing and portable.

5. The system of claim 4 wherein the first linkage means is coupled to the internal structure of the first unit and a second linkage means is also coupled to the internal structure of the first unit.

6. The system of claim 5 wherein said front most row of anchoring members project to a first height and wherein a second row of anchoring members are disposed further away from the front of the unit than the first row and wherein the anchoring members of the second-row project to a second height, and wherein the second height is greater than the first height.

7. The system of claim 6 wherein at least one or more subsequent rows of anchoring members project to progressively greater heights still.

8. The system of claim 7 wherein the anchoring members are generally triangular in shape.

9. The system of claim 8 wherein said angled section may be inclined at an angle of between about 15° and about 30°.

10. The system of claim 9, wherein the angled section is inclined at an angle of about 20° and the leading or front most anchoring member points in a slightly more forward direction compared to other anchoring members on each fin.

11. The system of claim 1 wherein said plurality of fins are aligned and affixed together in spaced relationship and thereby the series of rows of anchoring members are provided.

12. The system of claim 1 wherein the first linkage means passes through one or more fins of the internal structure and wherein a second linkage means passes though one or more of the other fins of the internal structure.

13. The system of claim 12 wherein the plurality of fins comprises first and second end-most fins and wherein the first linkage means passes through the first end-most fin and said second linkage means passes through the second end-most fin.

14. The system of claim 13 wherein the internal structure comprises six fins, arranged in parallel and arranged in a spaced arrangement.

15. The system of claim 11 wherein the fins each comprise one or more or a series of slots and the internal structure further comprises one or more or a matching number of transverse members, onto which said fins are slot-fitted and affixed.

16. The system of claim 14 wherein each internal structure comprises four transverse members, onto which six fins are slot-fitted and attached, wherein each fin has a front edge and a rear edge, the rear edge having a greater height above ground level than the front edge, and wherein first and second end-most fins receive part of the first linkage means and part of said second linkage means respectively.

17. The system of claim 13 wherein each internal structure comprises a central bottom plate having an aperture with an internal thread for receiving, locating and fastening a locking bolt, wherein a further plate is disposed between two fins and affixed thereto and is disposed above the central bottom plate, wherein the further plate comprises an aperture appropriately aligned relative to the internal thread in the bottom plate such that the locking bolt is securely held in place therein and such that said first and second linkage means are securely coupled to the internal structure of the impact barrier unit.

* * * * *